US009568287B2

(12) United States Patent
Nienke

(10) Patent No.: US 9,568,287 B2
(45) Date of Patent: Feb. 14, 2017

(54) RECOVERABLE AND REUSABLE AERIAL TARGET

(71) Applicant: Jeremy A. Nienke, Geneseo, IL (US)

(72) Inventor: Jeremy A. Nienke, Geneseo, IL (US)

( * ) Notice: Subject to any disclaimer, the term of this patent is extended or adjusted under 35 U.S.C. 154(b) by 0 days.

(21) Appl. No.: 14/795,661

(22) Filed: Jul. 9, 2015

(65) Prior Publication Data

US 2017/0010074 A1 Jan. 12, 2017

(51) Int. Cl.
*F41J 9/16* (2006.01)
*F41J 1/01* (2006.01)

(52) U.S. Cl.
CPC .... *F41J 1/01* (2013.01); *F41J 9/16* (2013.01)

(58) Field of Classification Search
CPC ..... F41J 9/16; F41J 1/01; F41J 9/08; A63H 33/18
USPC ..... 273/362–364; 446/46
See application file for complete search history.

(56) References Cited

U.S. PATENT DOCUMENTS 3,359,000 A * 12/1967 Schreiber ..... F41J 3/0004 273/365
3,359,678 A * 12/1967 Headrick ..... A63H 33/18 446/46
3,853,319 A 12/1974 Swanson
4,133,532 A 1/1979 Lante-Montefeltro Della Rovere
4,352,496 A * 10/1982 Lanti-Montefeltro Della Rovere ..... F41J 9/16 273/363
5,174,581 A 12/1992 Goodson
5,316,312 A * 5/1994 Dudley ..... F41J 9/08 273/362
5,706,762 A 1/1998 Dokken
5,720,664 A 2/1998 Brubacher
5,967,521 A 10/1999 Hellings
2004/0102131 A1* 5/2004 Orlowski ..... A63H 33/18 446/46
2012/0048251 A1 3/2012 Oblack et al.
2013/0154191 A1* 6/2013 Laporte ..... F41J 1/01 273/365
2014/0065919 A1* 3/2014 Oblack ..... A63H 33/18 446/46
2015/0079869 A1* 3/2015 Neth ..... A63H 33/18 446/46
2016/0040966 A1* 2/2016 Laporte ..... F41J 1/01 273/362

* cited by examiner

*Primary Examiner* — Mark Graham
(74) *Attorney, Agent, or Firm* — Dale J. Ream

(57) ABSTRACT

An aerial target that is reusable and recoverable after being launched, shot down or otherwise falling to the ground a body member having a saucer-shaped configuration and including a peripheral outer rim and a domed top wall extending upwardly from the outer rim, the body member including a central portion displaced from the outer rim and having a generally flat upper surface and an intermediate portion situated between the outer rim and the central portion, the intermediate portion having a domed configuration sloping downwardly from the central portion toward the outer rim. The body member includes an inner chamber substantially filled with air such that the body member is buoyant relative to water. The central portion is constructed of a hard rubber material that does not shatter after receiving an impact force and the intermediate portion is constructed of a self-healing material that reseals after being pierced by gun shot.

5 Claims, 7 Drawing Sheets

RECOVERABLE AND REUSABLE AERIAL TARGET

BACKGROUND OF THE INVENTION

This invention relates generally to aerial targets known as clay pigeons and, more particularly, an aerial target that is durable to the impact of a gunshot, is reused after being shot down, and is recoverable even from a body of water.

Clay pigeon shooting, also referred to as trap shooting or clay target shooting, refers to the launching of a clay target into the air and then being shot down by a sportsman with a shotgun. Clay target shooting is done by amateur hunters as practice and by experienced or even professional shooters in competitions. Aerial targets are typically made of clay or other brittle material. A shooter knows that his shot has hit the aerial target in that the target is fragmented, shattered, or completely reduced to dust upon being impacted by shot from the shotgun blast.

Variations of clay pigeons have been proposed in the art, such as biodegradable targets, targets having markers or even electronic components for tracking or identification, and having various compositions or frangibility. Although presumably effective for their intended purposes, the existing devices and proposals do not provide an aerial target that is both reusable and easily recoverage after being shot down or after falling from the sky after being missed.

Therefore, it would be desirable to have an aerial target that is not frangible but rather durable to deflect or absorb the impact from a shotgun blast. Further, it would be desirable to have an aerial target that includes an air chamber such that the target floats if it lands in water and is, thus, recoverable.

SUMMARY OF THE INVENTION

An aerial target that is reusable and recoverable after being launched, shot down, or otherwise falling to the ground according to the present invention includes a body member having a saucer-shaped configuration and including a peripheral outer rim and a domed top wall extending upwardly from the outer rim, the body member including a central portion displaced from the outer rim and having a generally flat upper surface and an intermediate portion situated between the outer rim and the central portion, the intermediate portion having a domed configuration sloping downwardly from the central portion toward the outer rim. The body member includes an inner chamber substantially filled with air such that the body member is buoyant relative to water. The central portion is constructed of a hard rubber material that does not shatter after receiving an impact force and the intermediate portion is constructed of a self-healing material that reseals after being pierced by gun shot.

Therefore, a general object of this invention is to provide an aerial target that is not frangible but rather is durable against the impact of a gunshot and impact with the ground.

Another object of this invention is to provide an aerial target, as aforesaid, having an air chamber protected from being pierced and which allows the target to float.

Still another object of this invention is to provide an aerial target, as aforesaid, having a hardened section that deflects or partially absorbs shotgun pellets.

Yet another object of this invention is to provide an aerial target, as aforesaid, having a section formed of self-healing material through which shotgun pellets can pass without shattering the target.

A further object of this invention is to provide an aerial target, as aforesaid, that can be retrieved by a dog.

A still further object of this invention is to provide an aerial target, as aforesaid, that can be launched from a clay pigeon launcher.

Other objects and advantages of the present invention will become apparent from the following description taken in connection with the accompanying drawings, wherein is set forth by way of illustration and example, embodiments of this invention.

BRIEF DESCRIPTION OF THE DRAWINGS

FIG. 4*b* is a lower elevation view of the aerial target as in FIG. 2, illustrating pellets from a shotgun shell discharge impacting the aerial target with some being deflected and others piercing and passing through.

DESCRIPTION OF THE PREFERRED EMBODIMENT

Figure 1:
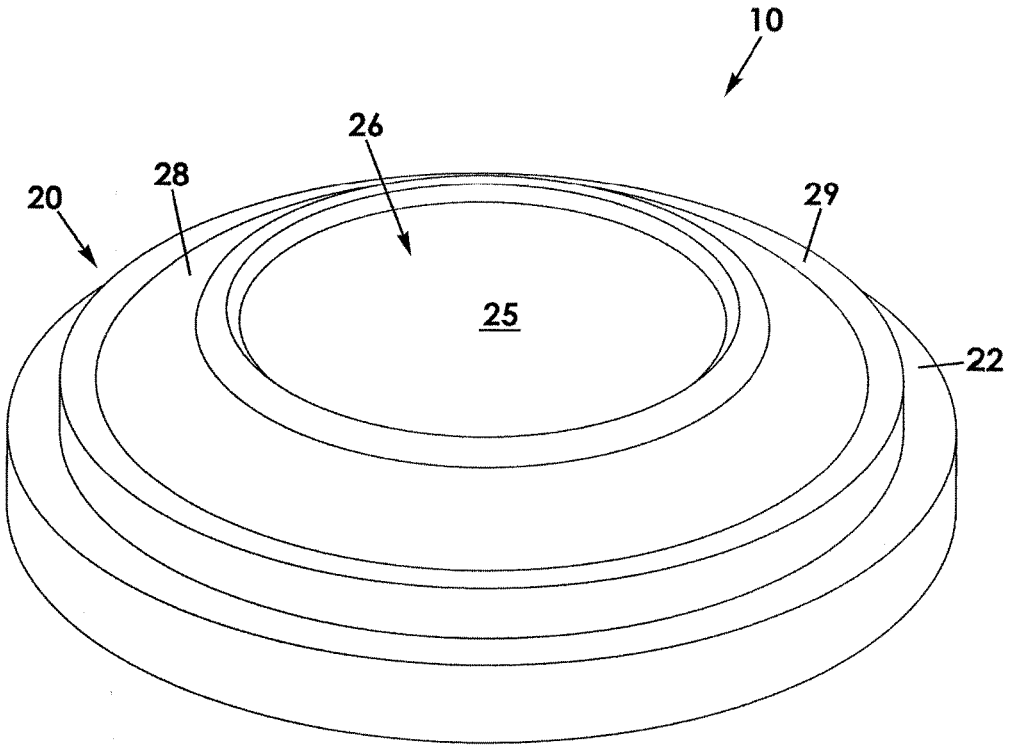
FIG. 1 is a perspective view of an aerial target according to a preferred embodiment of the present invention.
Figure 2:
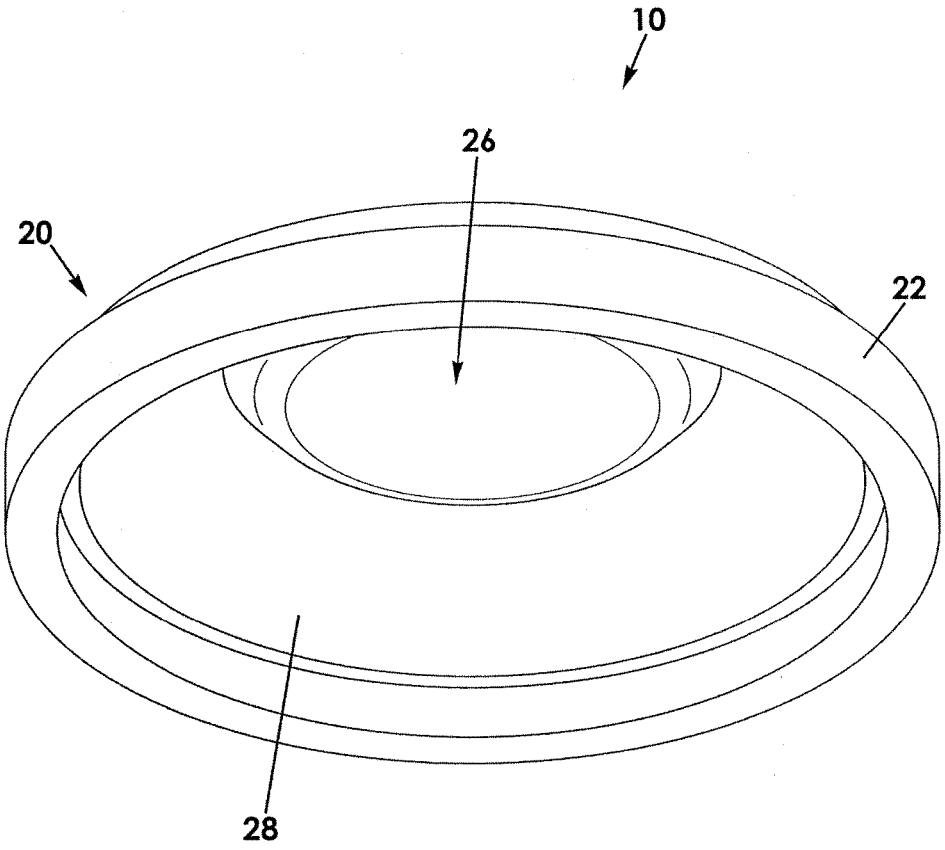
FIG. 2 is a lower elevation view of the aerial target as in FIG. 1.

An aerial target that is reusable and recoverable according to a preferred embodiment of the present invention will now be described with reference to FIGS. 1 to 4*c* of the accompanying drawings. The reusable and recoverable aerial target 10 includes a body member 20 a central portion 26, and, in some embodiments, an intermediate portion 28.

The body member 20 includes a saucer-shaped configuration that includes a perimeter outer rim 22 and a generally domed top wall extending upwardly from the outer rim 22. The body member 20 may include a central portion 26 displaced from the outer rim 22 and having a generally planer or flat upper surface 25. In some embodiments, the central portion 26 may span the complete diameter of the body member 20, i.e. a complete circular top surface between opposed points of the outer rim 22. But in one embodiment, the top wall of the body member 20 also includes an intermediate portion 28 situated between the central portion 26 and the outer rim 22, the intermediate portion 28 having a domed configuration sloping downwardly between the central portion 26 and the outer rim 22. The central portion 26 may include a "center point" of the top wall and it is accurate to describe the top wall as sloping downwardly from the center point toward the outer rim 22.

The central portion 26 defines an open interior space thereunder that is accessible through an open bottom defined by the rim 22. Further, the upper surface of the intermediate portion 28 of the top wall may include one or more concentric ridges 29 arranged in a tapered arrangement between the central portion 26 and the outer rim 22. The ridges 29 may enhance the aerodynamics of the body member 20 as well as to strengthen the rigidity thereof. Further, the outer rim 22 defines an open bottom in communication with the interior space defined a bottom surface of the top wall.

Figure 3A:
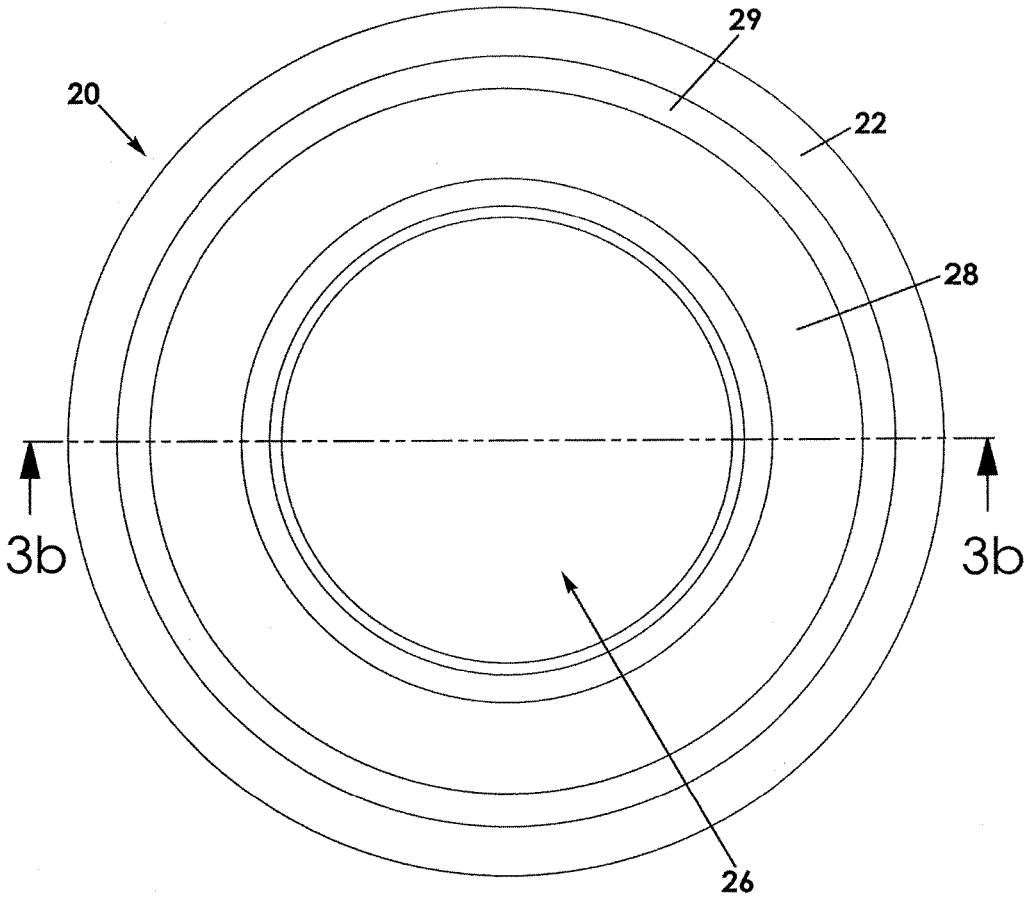
FIG. 3*a* is a top view of the aerial target as in FIG. 1.
Figure 3B:
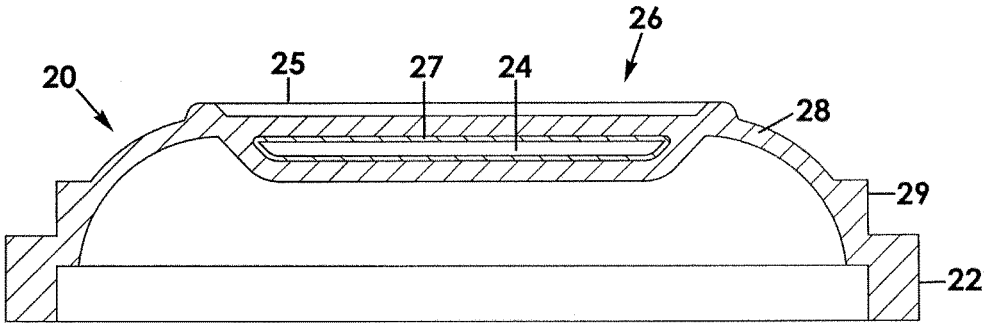
FIG. 3*b* is a sectional view taken along line 3*b*-3*b* of FIG. 3*a*, illustrating an embodiment having an air filled disc positioned in an air chamber.
Figure 3C:
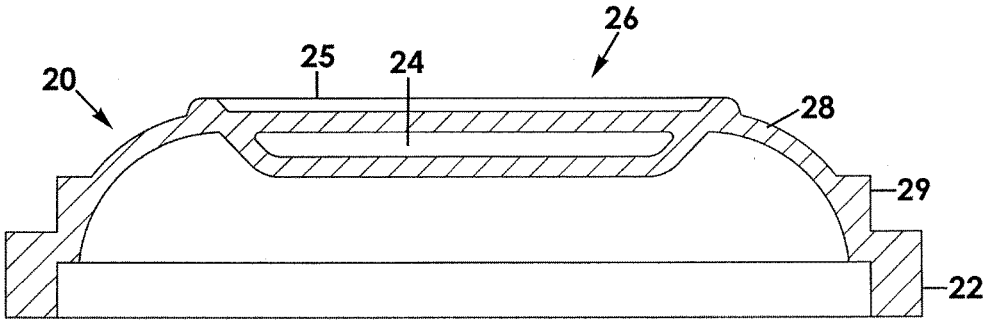
FIG. 3*c* is a sectional view taken along line 3*b*-3*b* of FIG. 3*a*, illustrating an embodiment in which air is sealed in the air chamber without use of a disc.

The body member 20 includes a chamber 24 that is partially or completely filled with air or other buoyant gas, the chamber being sealed. Preferably, air is placed in the chamber 24 at a point of manufacture, such as by injection during molding of the body member 20 (FIG. 3*c*). In an embodiment (not shown), the material may be impregnated with air bubbles or a material such as foam. In another embodiment, an actual sealed disc 27 filled with a quantity of air is inserted into the chamber 24 at a point of manufacture (FIG. 3*b*). The chamber 24 is coupled to a bottom surface of the central portion 26 of the top wall of the body member 20. In an embodiment, the chamber 24 may have a unitary construction with the central portion 26, i.e. the chamber 24 may be integrally formed with the top wall. In use, the air within the chamber 24 makes the body member 20 float if the aerial target 10 lands in a body of water, such as a pond, lake, stream, or the like. In other words, the aerial target 10 is recoverable even if it lands in a lake.

Unlike most clay pigeon targets, the aerial target 10 according to the present invention is not frangible, i.e. is not prone to shattering when impacted by the force of a shotgun blast or when hitting the ground. In one embodiment, the top wall of the body member 20 may be constructed of a hard rubber material that is durable and not shattered even when impacted by shot from a shotgun. Specifically, shot from a shotgun blast is either deflected or absorbed and the body member 20 is not shattered.

In another embodiment, only the central portion 26 is constructed of hard rubber material. More particularly, the intermediate portion 28 that extends between the outer rim 22 and the central portion 26 of the body member 20 may be constructed of a so-called "self-healing" material. Self-healing material is constructed of polymers that may include embedded adhesive or the like. When self-healing material is pierced, the embedded material leaks out and the holes or cracks are essentially sealed back up. Therefore, shot from a shotgun blast pass through the intermediate portion 28 of the body member 20 without substantially affecting its flight and without causing the body member 20 to shatter.

Figure 4A:
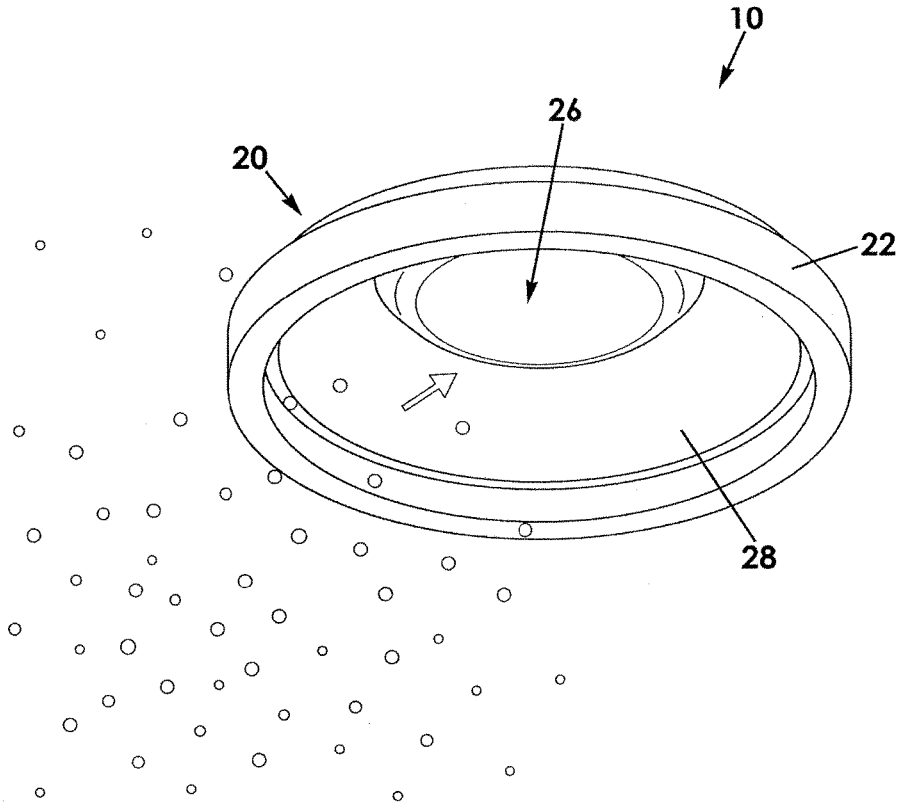
FIG. 4*a* is a lower elevation view of the aerial target as in FIG. 2, illustrating pellets from a shotgun shell discharge moving in the direction of the aerial target.
Figure 4B:
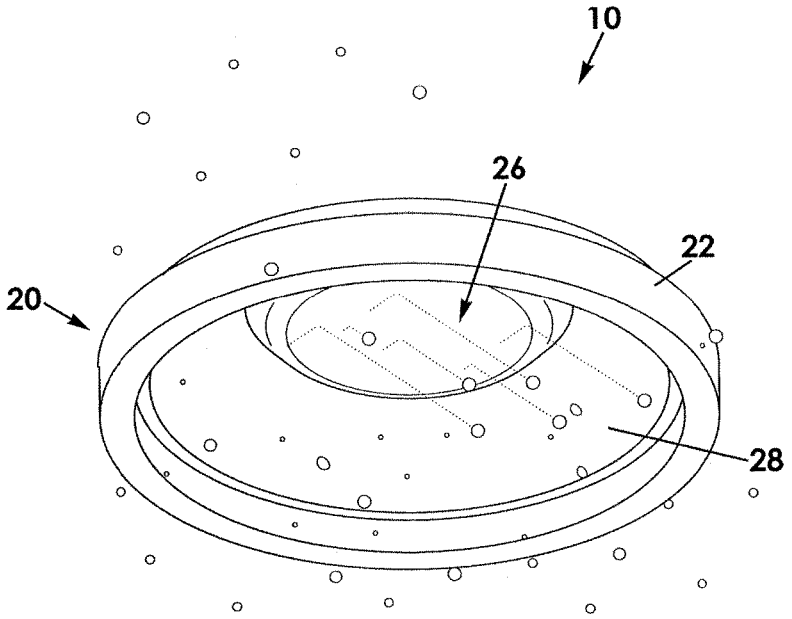
Figure 4C:
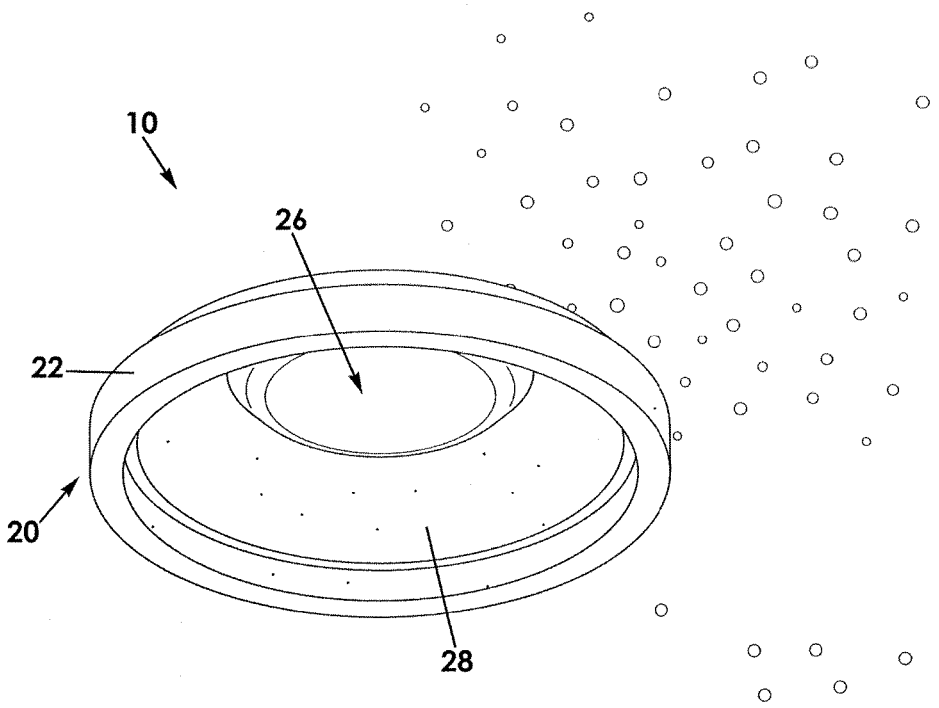
FIG. 4*c* is a lower elevation view of the aerial target as in FIG. 2, illustrating pellets from a shotgun shell discharge travelling away from the aerial target.

In use, an aerial target 10 may be placed in a traditional clay pigeon launcher (not shown) and hurled into the air so that a person can attempt to shoot it down with a shotgun. The hard rubber construction of at least the central portion 26 of the body member 20 substantially deflects the shot from a shotgun blast such that the aerial target 10 is not shattered by the shot (FIG. 4*b*). The aerial target 10 is able to continue its flight and may be retrieved once it falls to the ground. In the alternative embodiment described above, shot from a shotgun blast may pierce the intermediate portion 28 and pass on through. This "pass-through" alleviates some of the impact force that would otherwise be experienced by a shotgun blast (FIG. 4*c*). If the aerial target 10 were to land in a body of water, the air chamber 24 therein causes the body member 20 to float so that it may be retrieved by a person or even by a dog who understands how to "retrieve" an item.

It is understood that while certain forms of this invention have been illustrated and described, it is not limited thereto except insofar as such limitations are included in the following claims and allowable functional equivalents thereof.

The invention claimed is:

1. An aerial target that is reusable and recoverable after being launched from a clay pigeon launcher, shot down, or otherwise falling to the ground, said aerial target comprising:

- a body member having a saucer-shaped configuration capable of being selectively launched from the clay pigeon launcher and including a peripheral outer rim and a domed top wall extending upwardly from said outer rim, said body member including:
  - a central portion displaced from said outer rim and having a generally flat upper surface;
  - an intermediate portion situated between said outer rim and said central portion, said intermediate portion having a domed configuration sloping downwardly from said central portion toward said outer rim; and
  - a chamber coupled to a bottom surface of said central portion and substantially filled with air such that said body member is buoyant when resting on a body of water;
- wherein said central portion is constructed of a hard material that deflects shotgun pellets;
- wherein said intermediate portion is constructed of a self-healing material that reseals after being pierced by gun shot;
- wherein said intermediate portion includes a series of ridges in a downwardly tapered arrangement.

2. The aerial target as in claim 1, wherein said top wall of said body member defines an open interior area and said outer rim defines an open bottom in communication with said open interior area.

3. The aerial target as in claim 1, wherein said chamber and said central portion have a unitary construction.

4. The aerial target as in claim 1, wherein said self-healing material is a plastic polymer.

5. The aerial target as in claim 1, wherein said body member is not frangible when impacted by gun shot.

* * * * *